US005479789A

United States Patent [19]

Borten et al.

[11] Patent Number: 5,479,789

[45] Date of Patent: Jan. 2, 1996

[54] HEAT EXCHANGER FOR A HEAT PUMP

[75] Inventors: William H. Borten, Potomac, Md.; L. Jeremy Crews, Key Largo, Fla.

[73] Assignee: Aire Solutions, Inc., Carrolton, Tex.

[21] Appl. No.: 366,604

[22] Filed: Dec. 29, 1994

[51] Int. Cl.[6] ..... F25B 13/00

[52] U.S. Cl. ..... 62/324.1; 62/196.1; 62/513

[58] Field of Search ..... 62/160, 513, 83, 62/324.1, 196.1

[56] References Cited

U.S. PATENT DOCUMENTS

| | | | |
|---|---|---|---|
| 4,030,315 | 6/1977 | Harnish | 62/513 X |
| 4,111,005 | 9/1978 | Livesay | 62/503 |
| 4,147,479 | 4/1979 | Morse | 417/540 |
| 4,236,381 | 12/1980 | Imral et al. . | |
| 4,760,707 | 8/1988 | Dennis et al. | 62/513 X |

*Primary Examiner*—William Wayner

*Attorney, Agent, or Firm*—Rosenblatt & Redano

[57] ABSTRACT

The invention concerns controllable liquid line to suction line heat exchangers for use in reversible cycle heat pumps.

21 Claims, 2 Drawing Sheets

HEAT EXCHANGER FOR A HEAT PUMP

FIELD OF THE INVENTION

The invention concerns controllable liquid line to suction line heat exchangers for use in reversible cycle heat pumps.

BACKGROUND OF THE INVENTION

Reversible cycle heat pumps are utilized in applications requiring both heating and cooling functions, and these systems include the reversible cycle vapor compression refrigeration approach. Such systems employ two heat exchangers, one located inside the controlled volume and one located outside. The flow of refrigerant through these heat exchangers is reversible. With flow in a first direction, the system carries heat outside resulting in cooling of the controlled volume. With flow in the second direction, opposite to the first direction, the system carries heat inside resulting in warming of the controlled volume.

Refrigerant flow through the system is induced by a compressor. Because the compressor can only pump in one direction, a valving arrangement directs the refrigerant from the non-reversible compressor section into the reversible section containing both heat exchangers. In the non-reversible section, the refrigerant in the line leading to the compressor is in a gaseous, or vapor, state.

In the reversible section, there are two primary carrier lines transferring refrigerant between the heat exchangers. One line serves as a continuation of the vapor line feeding the compressor and may carry saturated refrigerant. This line and its continuation into the non-reversible section are called the suction line. The other primary carrier line in the reversible section carries liquid refrigerant and is called the liquid line.

During cooling operations, it is desirable to utilize a liquid line to suction line heat exchanger to improve cooling efficiency. In the cooling mode, the suction line carries gaseous refrigerant returning to the compressor from the inside heat exchanger. The liquid line carries liquid refrigerant from the outside heat exchanger, through the expansion device, to the inside heat exchanger. In this mode, a liquid line to suction line heat exchanger can improve system efficiency by using the remaining heat absorption capability of the vapor to lower the temperature of the liquid.

U.S. Pat. No. Re. 32,092 to Davis discloses a liquid line to suction line heat exchanger for use in a standard, that is, non-reversible, compression vapor refrigerant system. This heat exchanger provides higher operating efficiencies than for the same system operating without the Davis device. However, if the Davis device is used in a reversible cycle heat pump system, it would transfer heat in the other direction during heating operations. Such heat exchange is widely known to be detrimental to performance in the heating mode.

U.S. Pat. No. 4,236,381 to Imral, et al. discloses a liquid line to suction line heat exchanger for use in a heat pump that is intended to work primarily during heating operations. This design is intended for use in systems that do not accomplish full evaporation of the refrigerant in the exterior heat exchanger during heating operations. The goal of the Imral device is to protect the compressor from slugs of liquid refrigerant.

This design has three disadvantages. First, it effects heat exchange during the heating cycle which is detrimental to heat output. Second, it does not operate effectively nor is it intended to operate effectively during the cooling cycle. Third, it relies on vertical orientation to operate properly. Therefore, it could not operate reliably on airplanes, surface vessels, submarines, or spaceships, where vertical orientation or even gravity may not be constant or reliably available.

It is a goal of the present invention to provide a liquid line to suction line heat exchanger for use in a reversible cycle heat pump system which can be selectively used during the cooling cycle to improve system efficiency and selectively not used during the heating cycle so as to in no way be detrimental to system operation.

It is a further goal of this invention to provide a device which works in any spatial orientation.

It is still another goal of this invention to provide a device which may be either actively or passively controlled.

SUMMARY OF THE INVENTION

A liquid line to suction line heat exchanger is provided that utilizes a valve-controlled bypass system to isolate the heat exchanger from the system during heating operations. The system utilizes a two-line heat exchanger with the lines coupled into the liquid and suction lines. That is, the heat exchanger has a liquid line that is in fluid communication with the heat pump's liquid line, and a suction line that is in fluid communication with the heat pump's suction line. Within the heat exchanger, the liquid and suction lines are maintained in fluid isolation but in thermal communication. Commercially available heat exchangers suitable for this purpose are manufactured by Parker-Hanifin.

A bypass line is coupled into either the liquid line or the suction line so that, if flow is directed through the bypass line, there will be no flow through the heat exchanger on the coupled line. Thus, when the bypass line is in fluid communication with either the heat exchanger suction line or the heat exchanger liquid line, flow is bypassed so that no heat exchange takes place.

The fluid coupling of the bypass line may be accomplished by means of a single three-way valve which directs flow through either the bypass line or the heat exchanger. The coupling may also be accomplished by two two-way valves, such as check valves or actively controlled valves, used to open or close the line through the heat exchanger while simultaneously closing or opening the bypass line. Valves suitable for this application are those manufactured by Watsco or the equivalent.

DETAILED DESCRIPTION OF THE PREFERRED EMBODIMENTS

Figure 1:
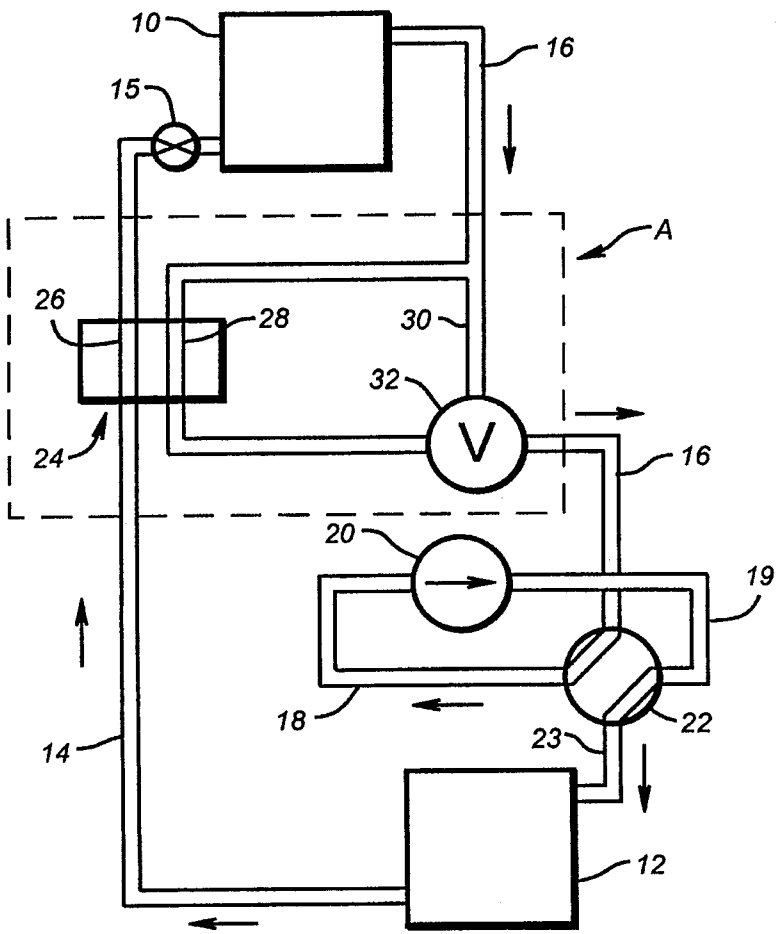
FIG. 1 is a flow diagram depicting the present invention in the cooling mode with the liquid line to suction line heat exchanger in the reversible section.

Referring to FIG. 1, a first embodiment of the present invention is shown. The heat exchanger system is installed in a reversible vapor compression heat pump system. The heat pump system comprises a reversible section and a non-reversible section. The reversible section comprises a reversible interior heat exchanger 10, a reversible exterior heat exchanger 12, a reversible liquid line 14, an expansion device 15, a reversible suction line 16, and a reversible transfer line 23. In the preferred embodiment, the expansion device 15 is a bi-directional expansion device. The non-reversible section comprises a non-reversible suction line 18, a non-reversible compressor 20, and a non-reversible compressor discharge line 19. The direction of flow through the reversible section is controlled by a four-way valve 22.

The liquid line to suction line heat exchanger 24 comprises a heat exchanger liquid line 26, a heat exchanger suction line 28, a heat exchanger bypass line 30, and a flow control device 32. In this embodiment, the heat exchanger liquid line 26 is in fluid communication with the reversible liquid line 14, and the heat exchanger suction line 28 is in fluid communication with the reversible suction line 16. The heat exchanger liquid line 26 and the heat exchanger suction line 28 are in liquid isolation and thermal communication.

Figure 2:
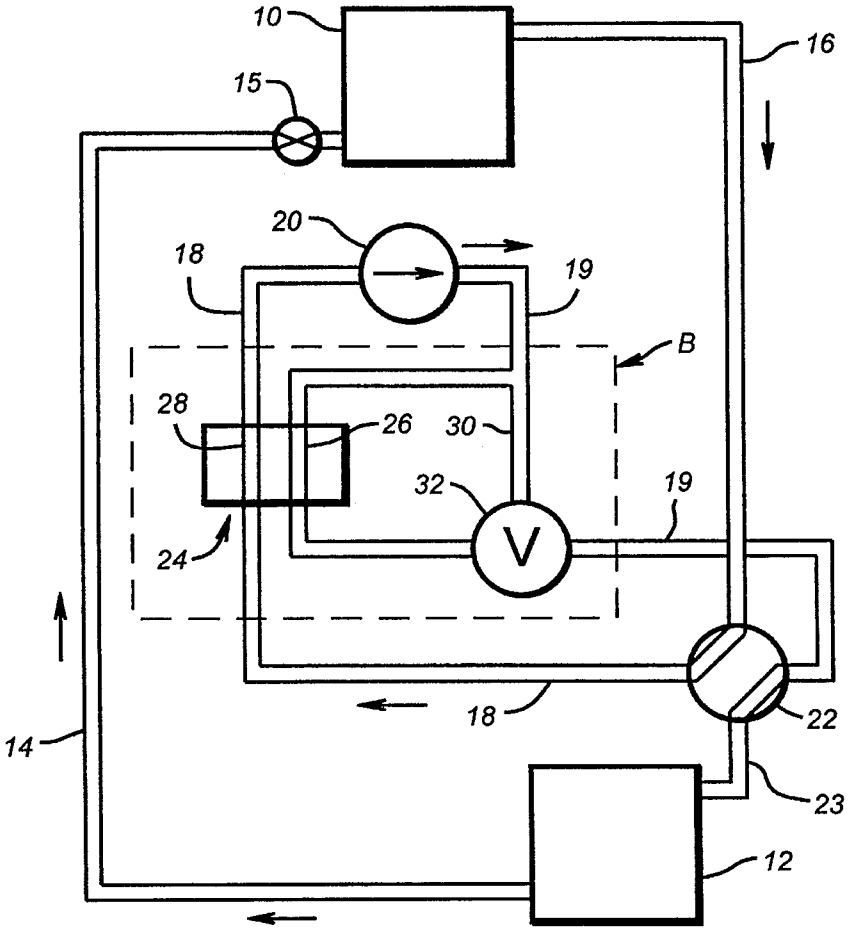
FIG. 2 is a flow diagram depicting the present invention in the cooling mode with the liquid line to suction line heat exchanger in the non-reversible section.

The flow control device 32 may comprise one or more actively controlled valves or one or more passively controlled valves. If the valves are actively controlled, the heat exchanger may be placed in either the reversible or the non-reversible section. An example of placement in the non-reversible section is shown in FIG. 2. However, the preferred embodiment uses passively controlled valves, such as those depicted in FIG. 3A, to lower power requirements and eliminate control circuitry and equipment. Passively controlled valves must be placed in the reversible section, because they rely on the reversal of refrigerant flow to effect the bypass of the heat exchanger.

Referring to FIG. 1, with the reversible cycle heat pump in cooling mode, high-pressure gas flows from the non-reversible compressor 20, through the non-reversible compressor discharge line 19 and the four-way valve 22. From the four-way valve 22, the high-pressure gas flows through the reversible transfer line 23 into the reversible exterior heat exchanger 12. Liquid refrigerant exits the reversible exterior heat exchanger 12 through the reversible liquid line 14. Liquid refrigerant from the liquid line 14 passes through the heat exchanger liquid line 26 and through the expansion device 15 to the interior heat exchanger 10. Gaseous refrigerant exits the interior heat exchanger 10 through the reversible suction line 16 and flows through the heat exchanger suction line 28. In the heat exchanger 24, the gaseous refrigerant in the heat exchanger suction line 28 is vaporized by heat from the liquid refrigerant in the heat exchanger liquid line 26, thereby lowering the total heat in the liquid refrigerant and improving the cooling efficiency of the heat pump system. On exiting the heat exchanger 24, the gaseous refrigerant returns to the reversible suction line 16 and continues through the four-way valve 22 to the non-reversible suction line 18 and then to the compressor 20 for the start of another cycle.

In heating mode, the four-way valve 22 is positioned to reverse the flow through the reversible section. In this mode, the flow control device 32 directs flow from the reversible suction line 16 through the heat exchanger bypass line 30. In this mode, flow through the heat exchanger liquid line 26 continues, but the heat exchanger has no appreciable effect on system operation because flow through the heat exchanger suction line 28 is bypassed. In an alternative configuration, the heat exchanger bypass line 30 may be placed in fluid communication with the heat exchanger liquid line 26 instead of the heat exchanger suction line 28. This alternative allows mechanical flexibility within the physical confines of the system without affecting system performance.

FIG. 2 depicts a second embodiment of the present invention. The heat exchanger suction line 28 is in fluid communication with the non-reversible suction line 18. Because the heat exchanger 24 is connected to the non-reversible section, the flow control device 32 cannot be a passively controllable device, but must be actively controllable. The flow control device 32 may be remotely actualable to allow the control system to be physically displaced from the valves.

Figure 3A:
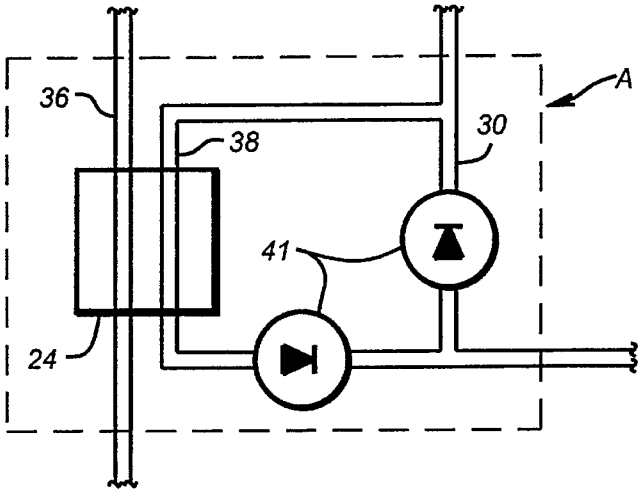
FIG. 3A depicts an alternative embodiment of Box 'A' from FIG. 1.

FIG. 3A depicts an alternative embodiment of Box 'A' from FIG. 1. The liquid line to suction line heat exchanger 24 comprises a first heat exchanger line 36 and a second heat exchanger line 38. It is understood that the first heat exchanger line 36 may be in fluid communication with the reversible liquid line 14, the reversible suction line 16, the non-reversible suction line 18, or the non-reversible compressor discharge line 19.

If the first heat exchanger line 36 is in fluid communication with the reversible liquid line 14, the second heat exchanger line 38 will be in controllable fluid communication with the reversible suction line 16. Conversely, if the first heat exchanger line 36 is in fluid communication with the reversible suction line 16, the second heat exchanger line 38 will be in controllable fluid communication with the reversible liquid line 14.

Similarly, if the first heat exchanger line 36 is in fluid communication with the non-reversible compressor discharge line 19, the second heat exchanger line 38 will be in controllable fluid communication with the non-reversible suction line 18. If the first heat exchanger line 36 is in fluid communication with the non-reversible suction line 18, the second heat exchanger line 38 will be in controllable fluid communication with the non-reversible compressor discharge line 19.

The heat exchanger bypass line 30 is in controllable fluid communication with the same line as the second heat exchanger line 38. Refrigerant flows either through the heat exchanger bypass line 30 or the second heat exchanger line 38. The flow control device 41 comprises two passively controlled valves.

Figure 3B:
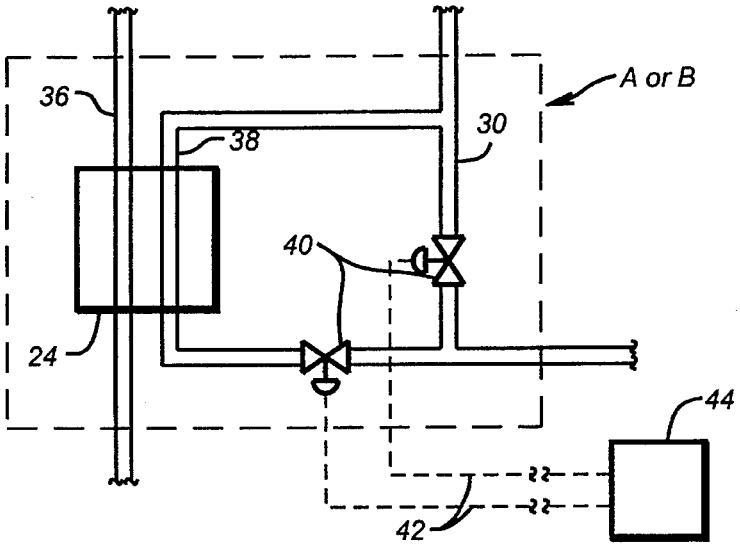
FIG. 3B depicts an alternative embodiment of Box 'A' from FIG. 1 or Box 'B' from FIG. 2.

FIG. 3B depicts an alternative embodiment of either Box 'A' in FIG. 1 or Box 'B' in FIG. 2. As in FIG. 3A, the liquid line to suction line heat exchanger 24 comprises a first heat exchanger line 36 and a second heat exchanger line 38. It is understood that the first heat exchanger line 36 may be in fluid communication with the reversible liquid line 14, the reversible suction line 16, the non-reversible suction line 18, or the non-reversible compressor discharge line 19.

If the first heat exchanger line 36 is in fluid communication with the reversible liquid line 14, the second heat exchanger line 38 will be in controllable fluid communication with the reversible suction line 16. Conversely, if the first heat exchanger line 36 is in fluid communication with the reversible suction line 16, the second heat exchanger line 38 will be in controllable fluid communication with the reversible liquid line 14.

Similarly, if the first heat exchanger line 36 is in fluid communication with the non-reversible compressor discharge line 19, the second heat exchanger line 38 will be in controllable fluid communication with the non-reversible suction line 18. If the first heat exchanger line 36 is in fluid communication with the non-reversible suction line 18, the second heat exchanger line 38 will be in controllable fluid communication with the non-reversible compressor discharge line 19.

The heat exchanger bypass line 30 is in controllable fluid communication with the same line as the second heat exchanger line 38. Refrigerant flows either through the heat exchanger bypass line 30 or the second heat exchanger line 38. The flow control device 40 comprises a plurality of actively controlled two-way valves. Control lines 42 allow the active control 44 to be remote from the flow control device 40.

Figure 3C:
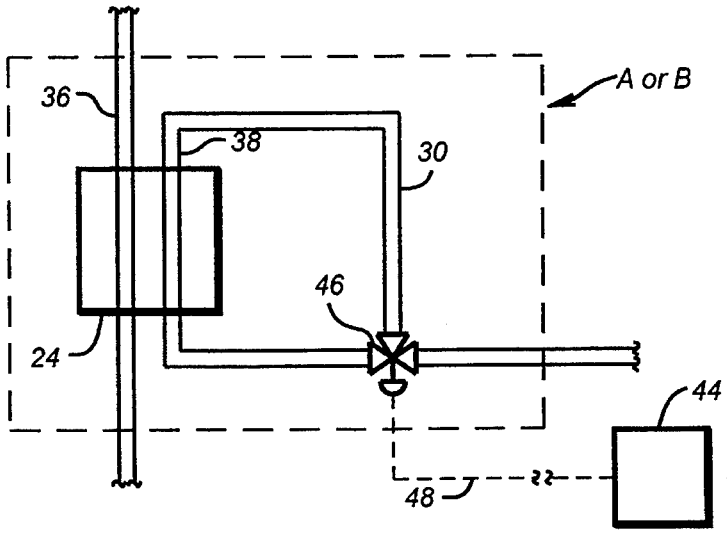
FIG. 3C depicts an alternative embodiment of Box 'A' from FIG. 1 or Box 'B' from FIG. 2.

FIG. 3C depicts an alternative embodiment of either Box 'A' in FIG. 1 or Box 'B' in FIG. 2. As in FIG. 3A, the liquid line to suction line heat exchanger 24 comprises a first heat exchanger line 36 and a second heat exchanger line 38. It is understood that the first heat exchanger line 36 may be in fluid communication with the reversible liquid line 14, the reversible suction line 16, the non-reversible suction line 18, or the non-reversible compressor discharge line 19.

If the first heat exchanger line 36 is in fluid communication with the reversible liquid line 14, the second heat exchanger line 38 will be in controllable fluid communication with the reversible suction line 16. Conversely, if the first heat exchanger line 36 is in fluid communication with the reversible suction line 16, the second heat exchanger line 38 will be in controllable fluid communication with the reversible liquid line 14.

Similarly, if the first heat exchanger line 36 is in fluid communication with the non-reversible compressor discharge line 19, the second heat exchanger line 38 will be in controllable fluid communication with the non-reversible suction line 18. If the first heat exchanger line 36 is in fluid communication with the non-reversible suction line 18, the second heat exchanger line 38 will be in controllable fluid communication with the non-reversible compressor discharge line 19.

The heat exchanger bypass line 30 is in controllable fluid communication with the same line as the second heat exchanger line 38. Refrigerant flows either through the heat exchanger bypass line 30 or the second heat exchanger line 38. The flow control device 46 comprises an actively controlled three-way valve. A control line 48 allows the active control 44 to be remote from the flow control device 46.

Many modifications and variations may be made in the embodiments described herein and depicted in the accompanying drawings without departing from the concept of the present invention. Accordingly, it is understood that the embodiments described and illustrated herein are illustrative only and are not intended as a limitation upon the scope of this invention.

What is claimed is:

1. A heat exchange system for use in a reversible cycle heat pump comprising a suction line and a liquid line, said system comprising:

a) a heat exchanger suction line in fluid communication with the suction line of the reversible cycle heat pump;

b) a heat exchanger liquid line in fluid communication with the liquid line of the reversible cycle heat pump, and wherein said heat exchanger liquid line is in thermal communication with said heat exchanger suction line;

c) a heat exchanger bypass line in controllable fluid communication with said heat exchanger suction line; and d) a flow control device capable of controlling flow through said heat exchanger bypass line.

2. The heat exchange system of claim 1, wherein said flow control device is a three-way valve.

3. The heat exchange system of claim 2, wherein said valve is actively controllable.

4. The heat exchange system of claim 2, wherein said valve is remotely actuatable.

5. The heat exchange system of claim 1, wherein said control device comprises a plurality of valves.

6. The heat exchange system of claim 5, wherein at least one of said valves is actively controllable.

7. The heat exchange system of claim 5, wherein at least one of said valves is passively controllable.

8. The heat exchange system of claim 5, wherein said valves are remotely actuatable.

9. A heat exchange system for use in a reversible cycle heat pump comprising a suction line and a liquid line, said system comprising:

a) heat exchanger suction line in fluid communication with the suction line of the reversible cycle heat pump;

b) a heat exchanger liquid line in fluid communication with the liquid line of the reversible cycle heat pump, and wherein said heat exchanger liquid line is in thermal communication with said heat exchanger suction line;

c) a heat exchanger bypass line in controllable fluid communication with said heat exchanger liquid line; and d) a flow control device capable of controlling flow through said heat exchanger bypass line.

10. The heat exchange system of claim 9, wherein said flow control device is a three-way valve.

11. The heat exchange system of claim 10, wherein said valve is actively controllable.

12. The heat exchange system of claim 10, wherein said valve is remotely actuatable.

13. The heat exchange system of claim 9, wherein said control device comprises a plurality of valves.

14. The heat exchange system of claim 13, wherein at least one of said valves is actively controllable.

15. The heat exchange system of claim 13, wherein at least one of said valves is passively controllable.

16. The heat exchange system of claim 13, wherein said valves are remotely actuatable.

17. A reversible vapor compression heat pump system comprising:

a) a reversible section comprising a reversible interior heat exchanger, a reversible exterior exchanger, a reversible suction line, and a reversible liquid line;

b) a non-reversible section comprising a non-reversible suction line, a non-reversible compressor discharge line, and a non-reversible compressor comprising an inlet and an outlet, wherein said inlet is in fluid communication with the non-reversible suction line, said outlet is in fluid communication with said non-reversible compressor discharge line, and said non-reversible suction line is in fluid communication with said reversible suction line; and c) a heat exchanger comprising a heat exchanger suction line in fluid communication with either said reversible suction line or with said non-reversible suction line, a heat exchanger liquid line in fluid communication with either said reversible liquid line or said non-reversible compressor discharge line, and wherein said heat exchanger liquid line is in thermal communication with said heat exchanger suction line, said heat exchanger further comprising a heat exchanger bypass line in controllable fluid communication with either said heat exchanger suction line or with said heat exchanger liquid line, and a heat exchanger flow control device capable of controlling flow through said heat exchanger bypass line.

18. The reversible vapor compression heat pump system of claim 17, wherein said heat exchanger flow control device comprises a three-way valve.

19. The reversible vapor compression heat pump system of claim 17, wherein said heat exchanger flow control device comprises plurality of valves.

20. The reversible vapor compression heat pump system of claim 19, wherein at least one of said valves is actively controllable.

21. The reversible vapor compression heat pump system of claim 19, wherein at least one of said valves is passively controllable.

* * * * *